US010668309B2

(12) United States Patent
Starholm et al.

(10) Patent No.: US 10,668,309 B2
(45) Date of Patent: Jun. 2, 2020

(54) ASSEMBLY FOR EXTRICATION AND RESCUE

(71) Applicants: Sverre Starholm, Hagan (NO); Rune Nilsen, Drammen (NO); Tore Buer, Oslo (NO)

(72) Inventors: Sverre Starholm, Hagan (NO); Rune Nilsen, Drammen (NO); Tore Buer, Oslo (NO)

( * ) Notice: Subject to any disclaimer, the term of this patent is extended or adjusted under 35 U.S.C. 154(b) by 239 days.

(21) Appl. No.: 15/565,605

(22) PCT Filed: Apr. 11, 2016

(86) PCT No.: PCT/IB2016/000614
§ 371 (c)(1),
(2) Date: Oct. 10, 2017

(87) PCT Pub. No.: WO2016/166606
PCT Pub. Date: Oct. 20, 2016

(65) Prior Publication Data

US 2018/0117371 A1 May 3, 2018

Related U.S. Application Data

(60) Provisional application No. 62/146,261, filed on Apr. 11, 2015, provisional application No. 62/263,842, filed on Dec. 7, 2015.

(51) Int. Cl.
*A62B 35/00* (2006.01)
*A45F 5/02* (2006.01)

(52) U.S. Cl.
CPC ..... *A62B 35/0006* (2013.01); *A45F 5/021* (2013.01); *A62B 35/0025* (2013.01)

(58) Field of Classification Search
CPC ..... A62B 35/0006; A62B 35/0025; A45F 5/021; A61G 7/1023
(Continued)

(56) References Cited

U.S. PATENT DOCUMENTS 3,973,643 A 8/1976 Hutchinson
4,937,920 A * 7/1990 Tsai ..... A44C 5/00 24/3.2
(Continued)

FOREIGN PATENT DOCUMENTS

CN 100435678 11/2008
WO 99/58008 A2 11/1999

OTHER PUBLICATIONS

Figure 5-19 (p. 88) of Fire Service Rapid Intervention Crews Principles and Practice, by Joe Nedder; Jones & Bartlett Learning, publisher; published Apr. 18, 2014. Submitted herewith as "NPL_training_book.pdf".
(Continued)

*Primary Examiner* — Nathan J Newhouse
*Assistant Examiner* — Lester L Vanterpool
(74) *Attorney, Agent, or Firm* — Underwood & Associates, LLC

(57) ABSTRACT

A rescue assembly for rapid extrication of a victim from a dangerous environment includes a wearable base member (101, 201) and a rescue strap (103, 104) deployable therefrom. The rescue strap (103, 104) extends outwardly from the base member (101, 201) allowing a rescuer to form a secure connection to a rescue for extrication. Keeper assemblies (208, 209) cooperatively retain the rescue strap (103, 104) within the base member (101, 201) until deployed by the rescuer and a release assembly provides the ability to quickly release the rescue strap from the base member if desired by the rescuer.

15 Claims, 7 Drawing Sheets

(58) Field of Classification Search
USPC ..... 224/159, 160
See application file for complete search history.

(56) References Cited

U.S. PATENT DOCUMENTS

| | | | | |
|---|---|---|---|---|
| 5,174,410 | A * | 12/1992 | Casebolt | A62B 35/04 182/3 |
| 5,341,973 | A * | 8/1994 | Dawes | A45F 3/04 221/185 |
| 5,970,517 | A | 10/1999 | Jordan | |
| 6,012,167 | A | 1/2000 | De Rosa et al. | |
| 6,189,651 | B1 * | 2/2001 | Sadeck | A62B 35/0025 182/3 |
| 6,481,528 | B2 | 11/2002 | Antonio | |
| 6,732,834 | B2 * | 5/2004 | Colorado | A62B 35/0031 182/3 |
| 6,851,516 | B2 * | 2/2005 | Petzl | A62B 35/04 182/3 |
| 7,051,836 | B2 | 5/2006 | Green | |
| 7,779,484 | B2 | 8/2010 | Fee et al. | |
| 8,336,171 | B2 * | 12/2012 | Colorado | A45F 3/10 224/675 |
| 8,360,202 | B1 * | 1/2013 | Woodard | A62B 1/16 182/3 |
| 8,505,171 | B2 * | 8/2013 | Colorado | A62B 9/04 224/675 |
| 8,573,359 | B2 * | 11/2013 | West | A62B 5/00 182/3 |
| 8,782,813 | B2 | 7/2014 | Usami | |
| 9,498,008 | B2 * | 11/2016 | Murphy | A41D 13/0007 |
| 2001/0054633 | A1 | 12/2001 | Marston | |
| 2008/0263755 | A1 | 10/2008 | Grilliot et al. | |
| 2009/0095232 | A1 * | 4/2009 | McKay | A62B 35/0006 119/770 |
| 2009/0127300 | A1 * | 5/2009 | Straight | A62B 35/0006 224/160 |
| 2009/0159364 | A1 * | 6/2009 | O'Brien | A45F 3/14 182/3 |
| 2009/0159365 | A1 * | 6/2009 | O'Brien | A62B 35/0025 182/3 |
| 2010/0193288 | A1 * | 8/2010 | Colorado | A62B 1/16 182/3 |
| 2010/0243372 | A1 * | 9/2010 | Wilkinson | A62B 35/0006 182/3 |
| 2011/0067953 | A1 * | 3/2011 | Kopp | A62B 1/16 182/3 |
| 2012/0017406 | A1 * | 1/2012 | Colorado | A62B 9/04 24/593.1 |
| 2012/0067666 | A1 * | 3/2012 | Smith | A62B 35/04 182/3 |
| 2012/0073026 | A1 | 3/2012 | Usami | |

OTHER PUBLICATIONS

"Personal Escape Systems Offer Simplified Use and Designs," Fire Apparatus Magazine (online version), Article published Jun. 4, 2013. Submitted herewith as "NPL_Fire_Apparatus.pdf.".

* cited by examiner

ASSEMBLY FOR EXTRICATION AND RESCUE

CROSS REFERENCE TO RELATED APPLICATIONS

This application claims priority to and the benefit of U.S. Provisional Patent Application Ser. No. 62/146,261, filed on 11 Apr. 2015 and U.S. Provisional Patent Application Ser. No. 62/263,842, filed on 7 Dec. 2015, the contents of both of which are incorporated by reference in their entirety as if fully set forth herein.

TECHNICAL FIELD

This disclosure relates to systems, assemblies and methods for extrication and rescue. In particular, this disclosure relates to a wearable assembly having deployable implements for securing a distressed or disabled person to a wearer of the assembly.

BACKGROUND

Those employed in firefighting, law enforcement, military entities and other similar professions can be put in harm's way by the very nature of their occupation. In many cases, these people train to be prepared for emergency situations which may involve the extrication of others, including co-workers, from dangerous environments. For example, firefighters frequently train to be efficient in rescue and extrication operations for a range of circumstances, including extricating persons from vehicles, dwellings, businesses and other situations. A variety of equipment is available to rescue personnel to both protect the rescuee and aid rescuers in rapidly and efficiently removing persons from danger. A need still exists, however, for wearable, low-profile rescue equipment that allows rescuers to perform 'hands-free' rescue.

Recently, there has been an unprecedented increase in the number of so-called 'active shooter' scenarios where one or more assailants attempt to maximize casualties in civilian settings. The sequence of events in such scenarios is tragically similar: one or more gunmen enter a building or venue and begin to inflict harm against as many people as possible, often choosing targets at random. Upon initial arrival, law enforcement and rescue personnel may confront a chaotic environment where, simultaneously, a mass evacuation of the premises may be underway, the assailants must be neutralized and rescue of those injured must be initiated.

It can be increasingly dangerous for personnel of any one agency to assume dual responsibility for both threat neutralization and victim search and recovery. For example, if a SWAT team member encounters a viable victim during a search for a perpetrator, that officer increases the victim's and his risk of being injured or killed if he must holster his weapon to use his hands to drag the victim to a safe location.

SUMMARY

In general, an assembly for rescue and extrication is provided. In one exemplary aspect, the assembly includes implements configured to allow a wearer of the assembly to couple himself to another person, such as an unconscious victim of violence. Implements of the assembly can include, for example, one or more straps configured to be extended around both the wearer of the assembly and the victim. The straps can be tightened so as to bring the wearer of the assembly and the victim into a confronting relationship which can aid in extracting the victim to a safe location. The assemblies described herein for rescue and extrication can be used, without limitation, by police officers, military personnel, firefighters, paramedics, emergency medical technicians and other professionals to rapidly extricate victims from a dangerous environment.

In one exemplary aspect, a rescue harness assembly is disclosed. The rescue harness assembly includes a rescue strap secured to a base member, and the base member includes at least one mounting element for securing the base member to an article of clothing or gear. The rescue harness further includes first and second connection members disposed on first and second end portions, respectively, of the rescue strap, wherein the base member is configured to contain the rescue strap in a pre-deployed configuration. In the pre-deployed configuration, left and right end portions of the rescue strap extend exteriorly from the base member to form graspable handle members for deploying the rescue strap.

In one embodiment, the at least one mounting element of the base member is configured for attachment to MOLLE or ALICE equipment, or to an SCBA assembly.

In one embodiment, the base member includes a fastener component disposed on at least one perimeter side of the base member for maintaining the base member in a folded configuration that envelops the rescue strap in the pre-deployed configuration.

In one embodiment, the rescue harness assembly further includes, for each of the left and right end portions of the rescue strap, at least one keeper component configured to releasably secure a portion of the rescue strap proximal to the graspable handle members to the base member. In a related embodiment, the keeper component includes a hook-side or loop-side length of a hook-and-loop fastener closure system secured to the rescue strap proximal to the graspable handle member, and a hook-side or loop-side length of a hook-and-loop fastener closure system secured proximal to a side of the base member. In a further related embodiment, for each of the first and the second end portions of the rescue strap, a first keeper component is configured to releasably secure a first side portion of the rescue strap to a first face portion of the base member. A second fastening component is configured to releasably secure a second side portion of the rescue strap, diametrically opposite to the first side portion, to a second face portion of the base member, such that when the base member is folded into the pre-deployed configuration, the first side portion of the rescue strap confronts the first face portion of the base member, and the second side portion of the rescue strap confronts the second face portion of the base member.

In another exemplary aspect, an assembly for the rescue or extrication of a rescuee is provided. The assembly includes a base member configured to be wearable by a rescuer, a rescue strap reversibly coupled to the base member, the rescue strap including first and second graspable handle portions on opposing end portions of the rescue strap, and a coupler independently disposed on each half of the rescue strap capable of providing a connection between the rescuer and the rescuee.

In one embodiment, the rescue strap includes separate first and second rescue strap portions. In a related embodiment, the assembly further includes a locking member attached to the base member, and first and second coupling members secured to the first and the second rescue strap portions, respectively. In this embodiment, the locking member and each of the first and second coupling members are cooperatively configured to releasably interlock each of the first and second rescue strap portions to each other and to the base member. In a related embodiment, the coupling member is a coupling ring.

In one embodiment, the assembly further includes a securement assembly for releasably securing the locking member in a configuration that prevents the coupling members and the locking member from unintentional release. In a related embodiment, the securement assembly includes a pocket disposed on the base member, a releasable securement lock disposed on the base member proximal to the pocket, and a securement member. The releasable securement lock is configured to pass through and fold over an end portion of the locking member or a ring secured to an end portion of the locking member. Furthermore, the pocket is configured to snugly receive the securement member, and the securement member is configured to pass through the releasable securement lock and be inserted into the pocket to prevent the coupling members and the locking member from being unintentionally released.

In one embodiment, the assembly further includes a release member coupled at one end to the securement member and which extends along a length of the first or the second rescue strap portion, providing the capability of shifting the securement member from the pocket to release the first and the second rescue strap portions from the base member.

In one embodiment, the base member includes an area of flexible material having a closure system configured to retain the flexible material in a folded configuration that substantially envelops the rescue strap, exclusive of the first and the second graspable handle portions, in a deployable configuration. In a related embodiment, the assembly further includes at least one keeper assembly configured to prevent deployment of the rescue strap from the base member, until the graspable handles are pulled outwardly to deploy the rescue strap. In a related embodiment, the keeper assembly includes a first portion of a fastener system disposed on the rescue strap proximal to the graspable handle portion and a second portion of the fastener system disposed proximal to a peripheral edge of the base member. The first and the second portion of the fastener system are releasably fastenable and configured to retain the rescue strap within the base member until the graspable handles are pulled outwardly to deploy the rescue strap. In a related embodiment, the fastening system is a hook-and-loop fastening system.

In yet another exemplary aspect, a rescue assembly for rapid extrication is disclosed. The rescue assembly includes a flexible base member configured to be worn by a rescuer that is convertable between open and closed configurations. The rescue assembly further includes first and second strap portions that cooperatively form a rescue strap. The first and second strap portions are reversibly interconnectable by a first interlocking system disposed on the base member. Each of the first and second portions of the rescue strap include a graspable handle member for deploying the rescue strap from the base member in the closed configuration and a connection member configured to couple to the connection member of the opposite strap portion. The rescue strap is configured to be extended around both the rescuer and a rescuee. The rescue assembly further includes a release handle disposed on either of the first or the second strap portions configured to release the first and the second strap portions from the base member, wherein each of the graspable handle members or a portion of each of the rescue strap portions are configured to be reversibly attached to each other.

In one embodiment, the rescue strap is configured such that the connection members of the first and the second portions of the rescue strap are capable of being connected about the chest of the rescuee, and the graspable handle members are configured to lock the rescuee's arms in an inferior orientation.

In one embodiment, the base member is configured to be attached to MOLLE or ALICE equipment or an SCBA assembly.

The systems, assemblies and methods disclosed herein provide distinct advantages in the practice of rescue and extrication. For example, adult victims in particular who are unable to self-rescue or extricate can be heavy and cumbersome to move. The rescue assemblies provided herein allow a rescuer to attach himself to a rescuee using, e.g., an extendable, cinchable strap. The strap can extend around the rescuer's hips and the rescuee's torso, providing a low center of gravity that the rescuer can use to his advantage. A further advantage is that the rescuer can execute rescue or extrication without directly grasping the victim. In this case, the rescuer's hands can be free to aid himself during the extrication, e.g., for balance or stability, or, when law enforcement or military personnel are involved, the rescuer's hands can be used to hold a weapon for providing cover or returning gun fire.

Yet a further advantage is that, in some embodiments, the rescue strap can be quickly and easily detached from the rescuer. This provides the ability for the rescuer to perform a victim extrication to a safe environment and quickly decouple so that the victim can be attended to by medical personnel or, in a hostage or active shooter situation, flee from the area. Furthermore, if the rescuer/rescuee pair find themselves in confrontation with a perpetrator, the rescuer can quickly decouple himself from the rescuee to engage the assailant, if necessary. Yet a further advantage is that the rescue strap can be of sufficient length to perform rescue or extrication on a variety of subject sizes, e.g., from children to adults.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

In general, a tactical extrication and rescue assembly (hereinafter TERA') is described. As will be apparent from the figures and description that follow, a TERA can be used by law enforcement, military, fire, ambulance or other personnel of similar professions to aid in the extrication of victims from a dangerous environment. In particular, TERAs of the type described herein allow a wearer to rapidly remove a victim from a dangerous environment while keeping the wearer's hands free to hold a weapon for providing cover or returning gunfire (in, e.g., police or military applications), for stability in low- or no-visibility environments (e.g., in firefighting applications) or any other purpose. In particular, a TERA provides the capability of a 'hands-free' removal of persons from a variety of dangerous environments, e.g., hostage or active-shooter situations, fires, IDLH (immediately dangerous to life and health) environments and others.

Figure 1:
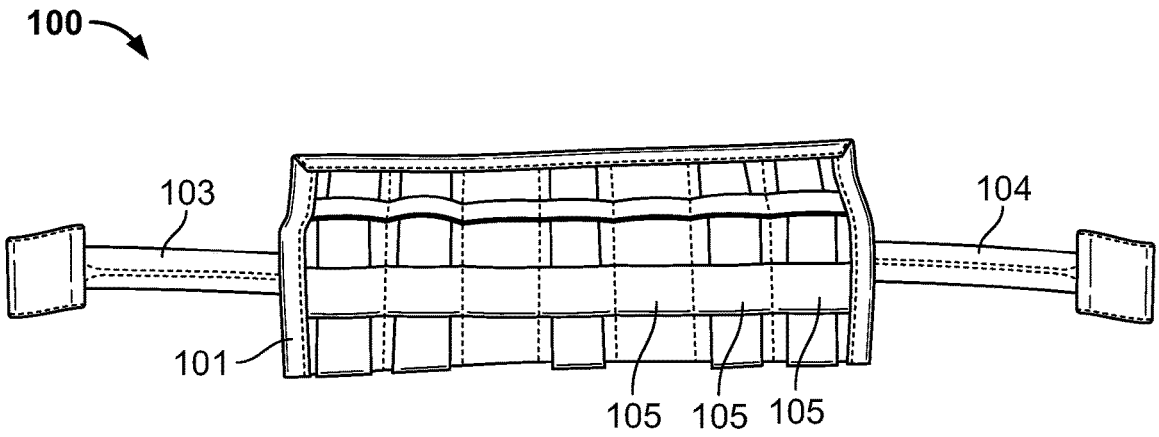
FIG. 1 is a rear-side view of a tactical extrication and rescue assembly (TERA), according to one embodiment.
Figure 2:
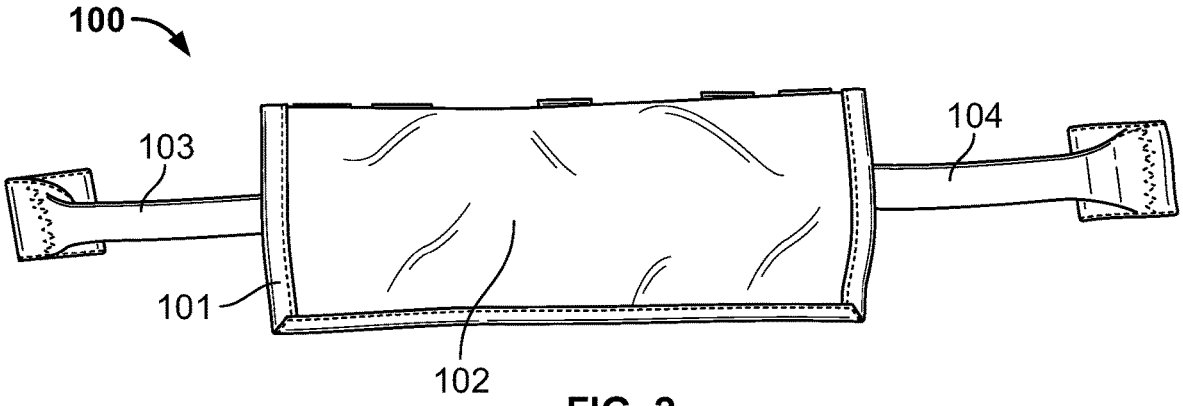
FIG. 2 is a front-side view of the TERA shown in FIG. 1.

Referring now to FIGS. 1 and 2, rear and front sides of a TERA 100 are shown, respectively, according to one embodiment. In this embodiment, the TERA 100 includes a base 101 made from a flexible, resilient fabric such as Nylon, although other fabrics and materials can be substituted as desired to meet design, functionality, weight, moisture repellency, camouflage or other considerations. In this embodiment, the rear side of the base 101 (shown in FIG. 1) includes pouch attachment ladder system (PALS) webbing 105 to enable TERA 100 to be attached to various types of modular lightweight load-carrying equipment (MOLLE) or all-purpose lightweight individual carrying equipment (ALICE) gear or other, similar tactical equipment used by, e.g., police, military, EMS and firefighting personnel. PALS webbing 105 is one of many options that can be used to attach TERA 100 to various equipment; other options include, but are not limited to: snaps, buckles and ties. In an alternative embodiment, TERA 100 can be integrally attached to equipment, clothing, gear or other wearables through stitching or other approaches.

TERAs of the type described herein are generally configured to be worn by a wearer (e.g., a police officer, SWAT officer, firefighter or soldier) in a compact, pre-deployed configuration, illustrated, for example, in FIGS. 1 and 2, out of the way of other tools, garments or other gear until a rescue or extrication is to be performed. In this embodiment, base 101 is configured to retain most of the person-to-person coupling implements of the TERA, such as straps, buckles and the like as described herein, neatly and securely stored in a pre-deployed configuration until rescue or extrication is to be performed.

Figure 3:
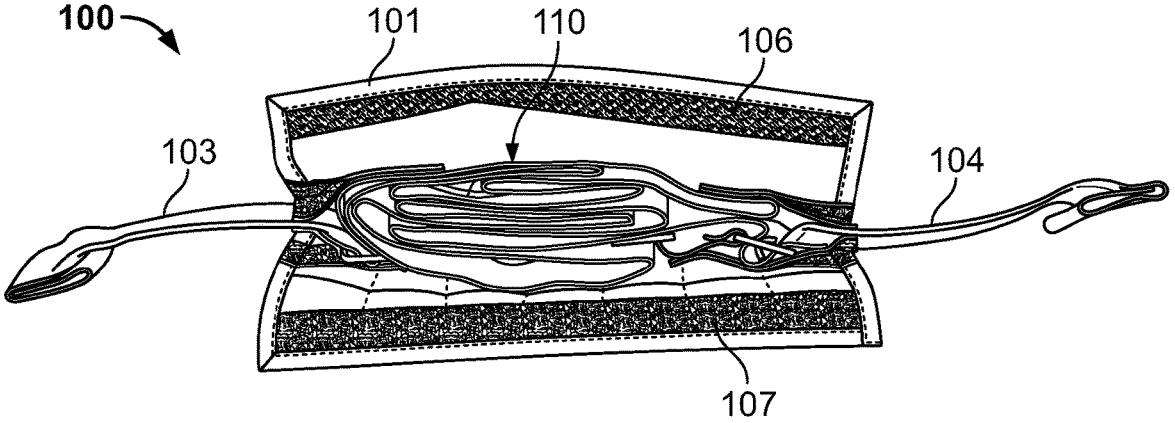
FIG. 3 is a side view showing internal components of the TERA of FIG. 1.

FIGS. 1 and 2 illustrate rear and front sides respectively of TERA 100 in an assembled, pre-deployed configuration. In this embodiment, left (103) and right (104) graspable handle members are formed from end portions of a continuous length of rescue strap 110 (FIG. 3). In the pre-deployed configuration shown in FIGS. 1 and 2, the left (103) and right (104) graspable handle members extend beyond the left and right sides of the base 101 as shown. In use, the TERA 100 can be attached to, e.g., a MOLLE vest such that the front side 102 of the TERA 100 faces away from the wearer's body. In the assembled, pre-deployed configuration shown in FIGS. 1 and 2, the base 101 is folded in half so as to substantially envelop the rescue strap 110 therewithin, excluding left (103) and right (104) graspable handle members.

Referring now to FIG. 3, in this embodiment, hook-and-loop fastener components such as those sold under the VELCRO® brand (Velcro Industries, Manchester, N.H.) are configured to envelop rescue strap 110 in the pre-deployed configuration. In this embodiment, a length of 'hook' material 106 is disposed along a top edge of the base 101 and a length of 'loop' material 107 is disposed along the bottom edge of the base 101 as shown, allowing the base 101 to be reversibly secured in a folded, pre-deployed configuration. In this way, the base 101 of the TERA 100 can also be opened easily to access the rescue strap 110 for inspection, re-packing or to perform other actions.

Tactical maneuvers performed by, e.g., police, SWAT, EMS, military and firefighting personnel are sometimes physically dynamic and demanding. As one will appreciate, it is generally important that, e.g., police officers' and firefighters' gear not become semi- or completely dislodged when running, climbing, engaging suspects in a physical confrontation or performing other maneuvers. Therefore, in this and other embodiments, base 101 is configured to securely retain rescue strap 110 until it is purposefully deployed as described below. In this embodiment, secure-ment of the rescue strap 110 within the base 101 is accomplished using hook-and-loop fastening components; however, it should be understood that other approaches and materials can be substituted according to preference or the type of physical activity that the wearer may be required to perform, such as through the use of buttons, snaps, ties or other approaches.

Figure 4:
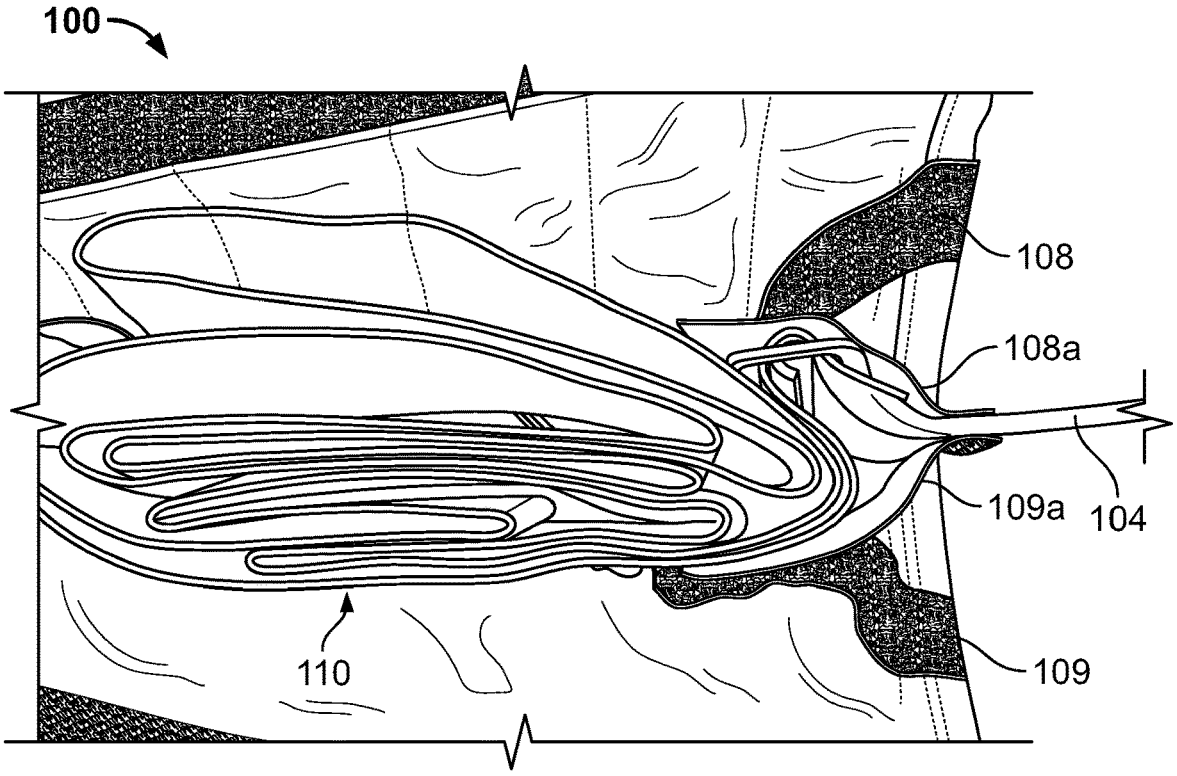
FIG. 4 is a magnified view of internal components of the TERA of FIG. 1.

Referring now to FIG. 4, a top, right-side view of TERA 100 illustrates rescue strap 110 folded within the base 101 and the right graspable handle member 104 extending therefrom. In this embodiment, each of the left (103) and right (104) graspable handle members of the rescue strap 110 are prevented from unintentional deployment from base 101 through the use of releasable keepers that releasably fasten a portion of the left (103) and right (104) graspable handle members, individually, to the body 101. (FIG. 4 illustrates a magnified view of only the right side of body 101 for figure clarity.) In this embodiment, each of the left (103) and right (104) graspable handle members, or a portion of rescue strap 110 proximal to the handle members, is configured with one-half of a keeper component which, in this embodiment is a length of the 'loop' side half of hook-and-loop fastening material 108*a*, 109*a*, respectively. The lengths of loop-side material are disposed on opposite faces of the rescue strap 110 at a location from the end of rescue strap 110 where graspable handle member 104 begins to extend exteriorly from base 101. (The left side of base 101 is similarly configured but not shown in FIG. 4 for figure clarity.) Corresponding lengths 108, 109 of the keeper 'hook' side of the hook-and-loop fastening system are disposed on base 101 such that when the base 101 is folded into the pre-deployed configuration shown, e.g., in FIGS. 1 and 2, the cooperating hook-and-loop keeper components, e.g., component 108/108*a* and 109/109*a*, respectively, are positioned in a confronting manner that effectively prevents the graspable handle members 103, 104 from shifting out of the base 101 unless acted upon by an outward pulling force.

Figure 5:
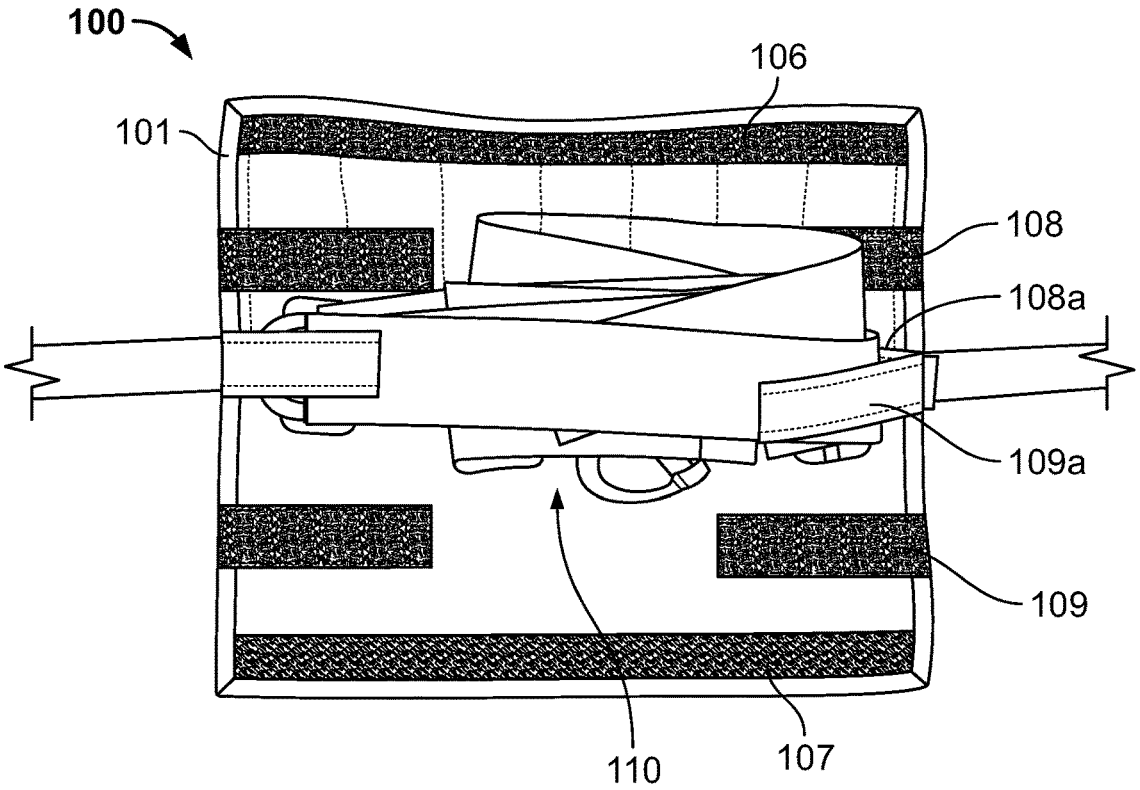
FIG. 5 shows the TERA of FIG. 1 in an open configuration.

FIG. 5 illustrates the interior of base 101 laid flat, in a fully opened and un-folded configuration showing the securement components of the left (103) and right (104) end graspable handle members and deployable implements of the TERA 100.

While hook-and-loop fastening systems such as those sold under the VELCRO® brand by Velcro Companies (Manchester, N.H., USA) are suitable as described herein for the purpose of reversibly securing various components of TERA 100, it should be understood that other, alternative fastening systems can be used, including, but not limited to snaps, buckles, buttons and the like.

Figure 6:
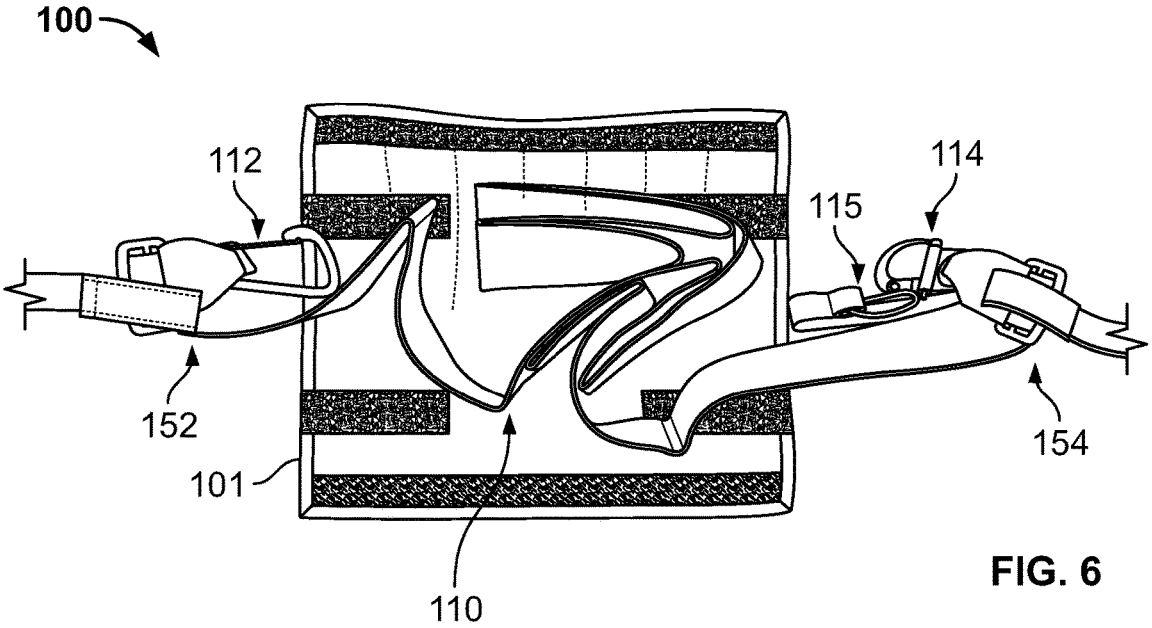
FIG. 6 shows the TERA of FIG. 1 in an open configuration.
Figure 7:
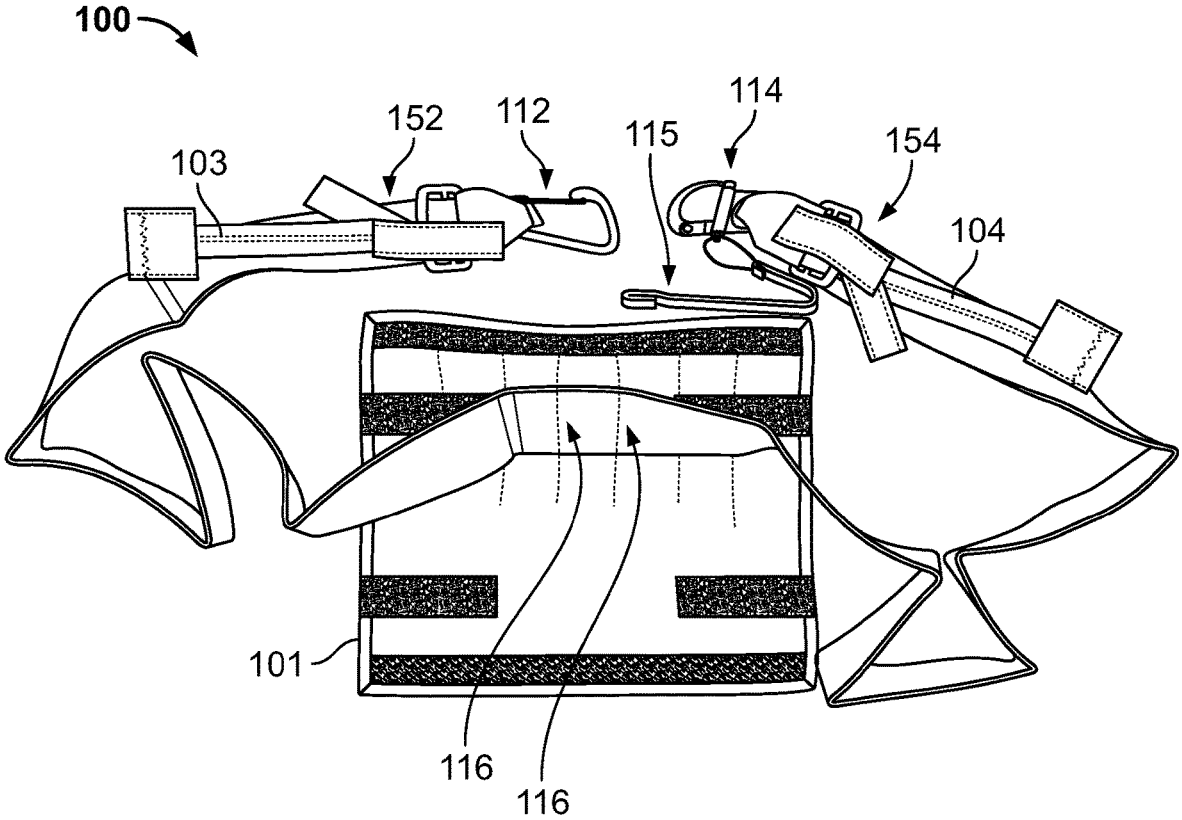
FIG. 7 shows the TERA of FIG. 1 in an open configuration.

In a preferred embodiment, the TERA 100 can be configured to be coupled to gear or clothing such that it can be worn on a user's back, where it is substantially out of the way of other wearable tactical components or gear. Rescue strap 110 can be of sufficient length that it may be extended around the torso of the rescuer and the rescuee as described in greater detail below and shown e.g., in FIG. 11. FIGS. 6 and 7 show the rescue strap 110 of the TERA 100 in a partially- and fully deployed configuration, respectively.

Figure 11:
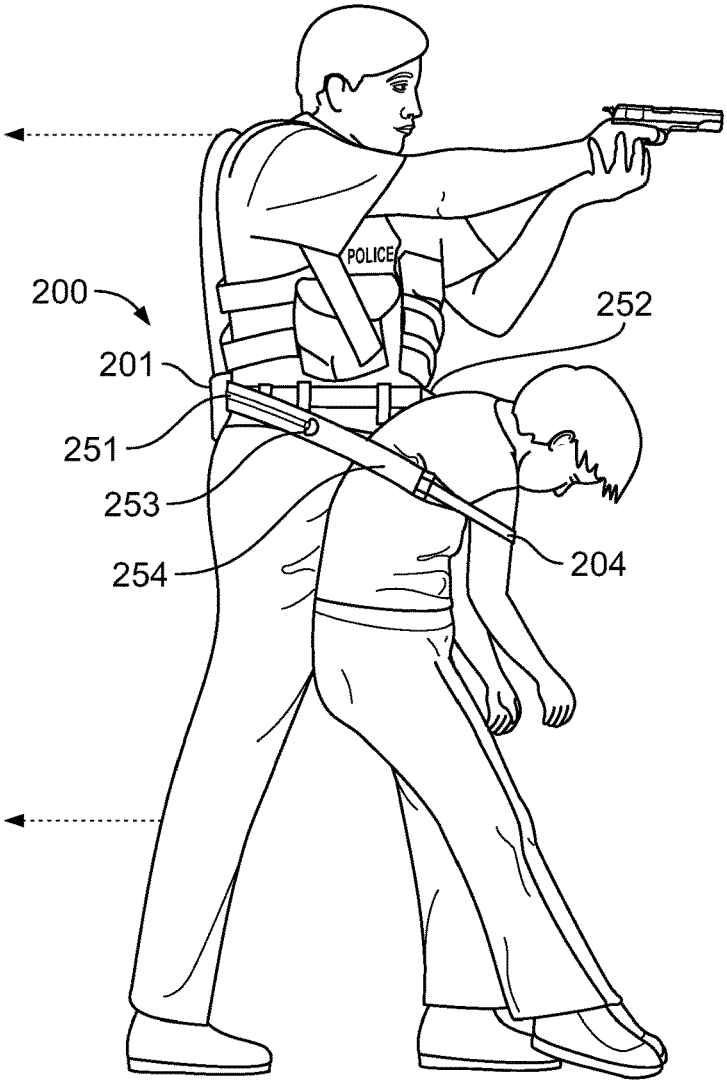
FIG. 11 illustrates one exemplary use of a TERA for rapid extrication of a victim.

In this and other embodiments, each of the left (152) and right (154) end portions of the rescue strap 110 can include a coupling member so that the rescue strap 110 can be reversibly coupled to form a substantially continuous loop around the rescuer and the rescuee as shown, e.g., in FIG. 11. FIGS. 5-7 show an exemplary carabineer-type coupler 112 engaged to the left end portion 152 and a snap shackle 114 engaged to the right end portion 154. Each coupler can be engaged to the left (152) or right (154) end portion via, e.g., a position-adjustable slide, buckle or other hardware. Snap shackle 114 includes a release handle 115 attached to a release pin for quick de-coupling of left (152) and right (154) end portions of rescue strap 110. It should be understood that the carabineer-type coupler 112 and snap shackle 114 are two of many different types of coupling mechanisms that can be used for coupling left (152) and right (154) end portions together to form a substantially continuous loop of the rescue strap 110. Other couplers, fasteners and similar hardware can be substituted according to preference.

Similarly, the coupling members need not necessarily be configured to form a loop of the rescue strap 110. In other approaches, the length of the rescue strap 110 and the coupling hardware used can be configured for direct attachment onto clothing or gear of a rescuee. For example, a carabineer-type coupler 112 can be positioned on both the left (152) and right (154) end portions so that each end of the rescue strap 110 can be attached to a connection member on a tactical vest, firefighter self-contained breathing apparatus (SCBA) bracket, firefighter turn-out jacket, MOLLE assembly, belt or other gear.

In this embodiment, rescue strap 110 is of sufficient length so as to allow the rescuer to couple each end portion of the belt around a rescuee, e.g., around the torso, and further configured to provide a terminal end portion (graspable handle member 103 or 104, or both) that the rescuer can grip and pull to tighten rescue strap 110 around himself and the rescuee. This allows the rescuer to provide a close body-to-body tandem connection which can, in turn, provide additional stability when extricating the rescuee by minimizing 'swing' between the two persons. When the TERA 100 is worn around the lower back, e.g., above the hips, the connection provides a low center-of-gravity that can reduce back injuries that otherwise may occur when a rescuer extricates a rescuee using his arm and upper body muscles.

Figure 8:
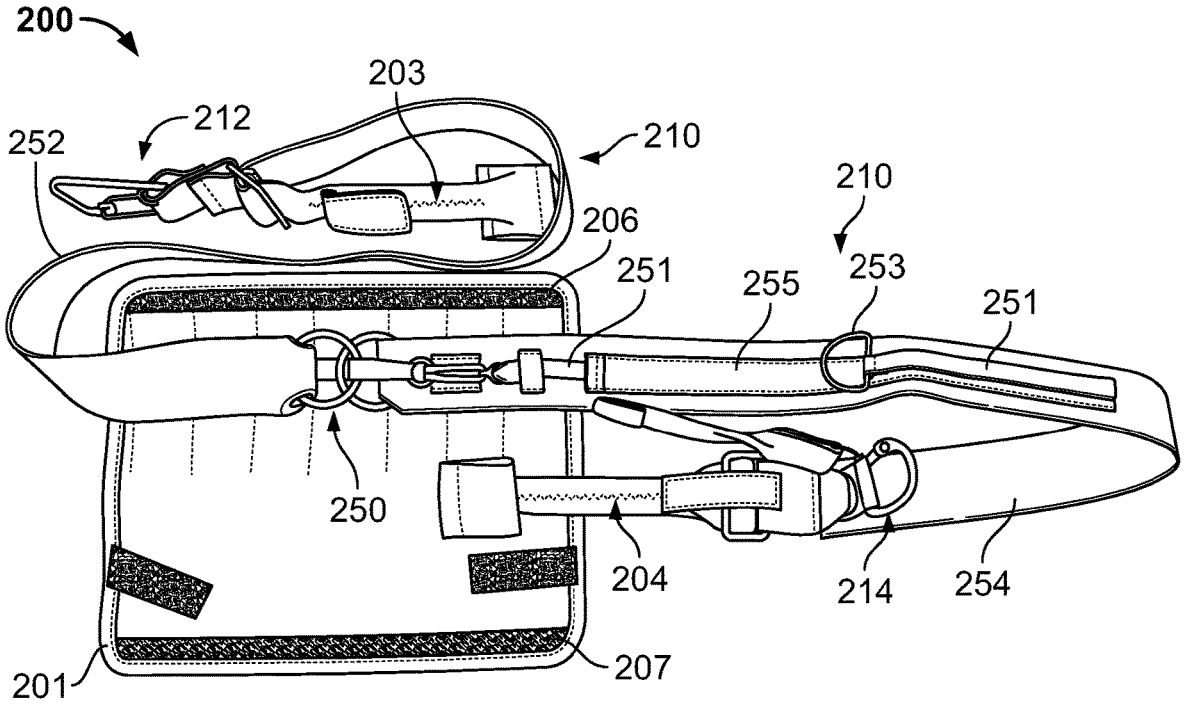
FIG. 8 shows a TERA according to a second embodiment.
Figure 9:
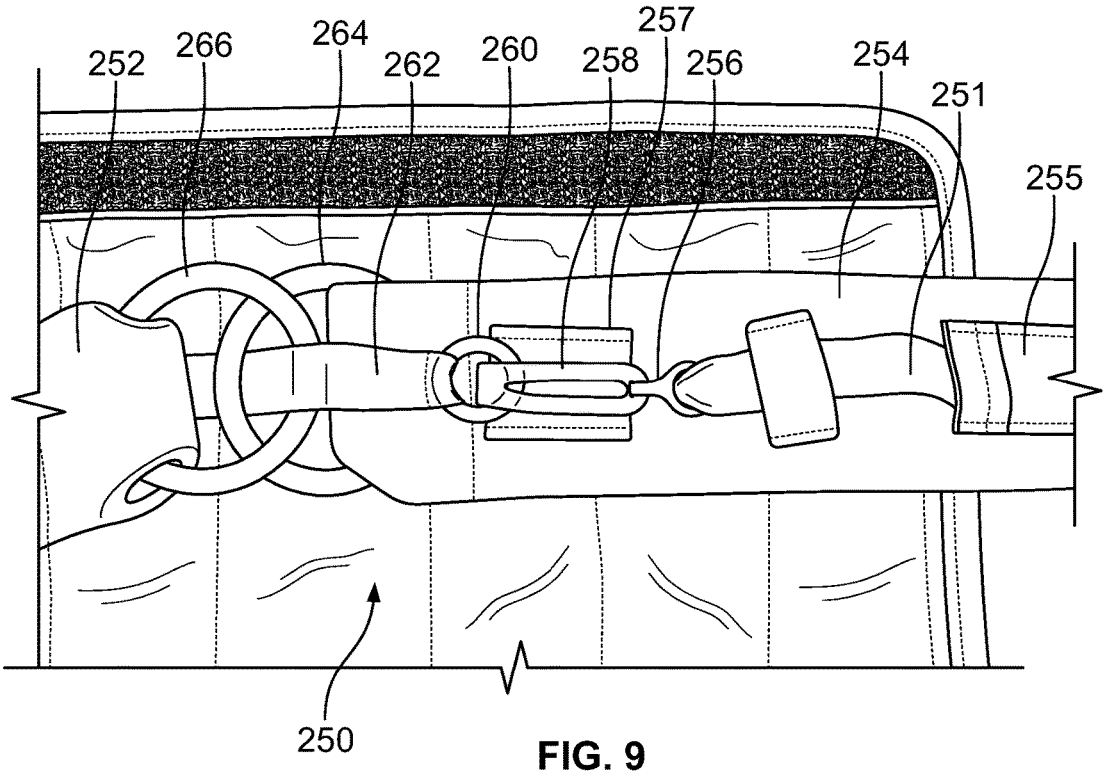
FIG. 9 shows portions of a release assembly of the TERA shown in FIG. 8, according to one embodiment.
Figure 10:
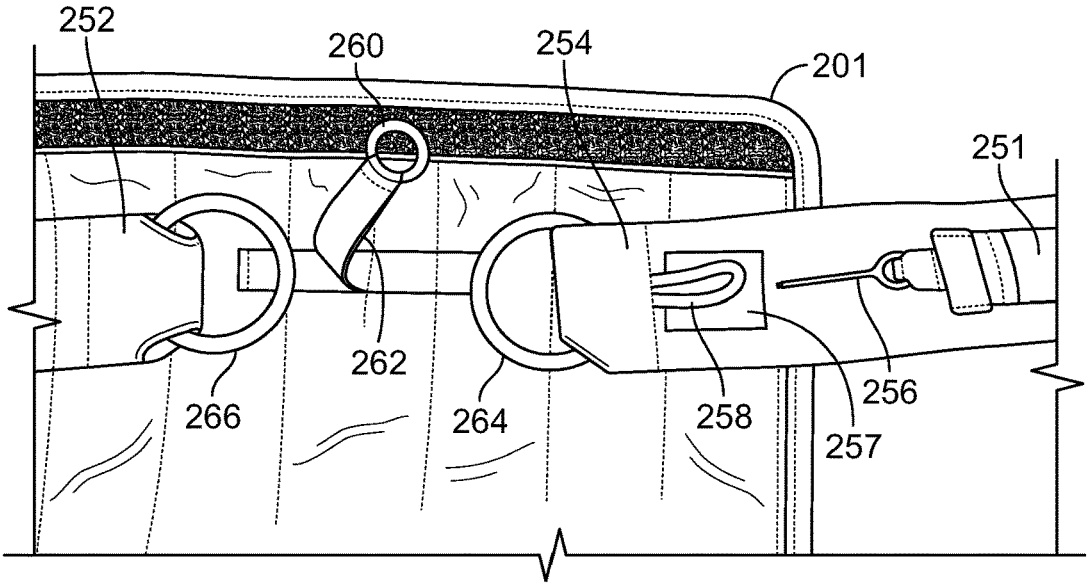
FIG. 10 shows portions of the release assembly shown in FIG. 9, according to one embodiment.

Referring now to FIGS. 8-10, a TERA 200 is shown according to an alternative embodiment. TERA 200 is substantially similar to TERA 100 shown and described with respect to FIGS. 1-7, with the exception that in this embodiment, the rescue strap 210 is formed from separate, reversibly couplable left (252) and right (254) belt portions as described in greater detail below. Like TERA 100, TERA 200 includes a base 201 that can be formed of a similar fabric as TERA 100, which is configured to be folded in half and reversibly closed via hook (206) and loop (207) fastener components sewn into top and bottom inner perimeter portions of the base 201 as shown. Like TERA 100, rescue strap 210 is configured to be stored within the folded base 201, with the exception of left (203) and right (204) graspable handle members. In this embodiment, keeper components 208/208*a*, 209/209*a* are hook-and-loop fastener components that function cooperatively to retain rescue strap 210 within base 210 in the same way as keeper components 108/108*a*, 109/109*a* described above with respect to TERA 100.

In this embodiment, left (252) and right (254) portions of rescue strap 210 are releasably coupled by release assembly 250. Referring to FIGS. 8 and 9 in particular, in this embodiment, release assembly 250 allows the left (252) and right (254) portions to be reliably coupled together to form an effective rescue belt for performing extrication, but also provides the capability of completely detaching rescue strap 210 from base 201 and thereby, the rescuer. Such functionality can be beneficial, for example, in cases where a rescuer has extricated a rescuee from a dangerous environment, but needs to quickly decouple from the rescuee to perform additional rescue functions, search for suspects, provide medical attention to the rescuee or perform other actions.

FIG. 9 is a magnified view of release assembly 250 coupling left (252) and right (254) portions of rescue strap 210 in an operative configuration for performing rescue or extrication. In this embodiment, a locking member, locking strap 262, is attached to base 201 at one end via reinforced stitching, and on an opposite end there is disposed in a securely coupled configuration, ring 260 as shown. In this embodiment, coupling rings 266, 264 are secured to each respective end portion of the left (252) and right (254) portions of the rescue strap 210 as shown. The coupling rings 266, 264 are configured such that ring 260 and a portion of locking strap 262 can pass therethrough. Thus, in this embodiment, locking strap 262 and coupling rings 266, 264 cooperatively function to interlock left (252) and right (254) portions of the rescue straps to each other and to base 201. It should be understood that coupling rings 266, 264 are releasably interlocked by virtue of locking strap 262 passing through each ring, which prevents the rings from being shifted away from each other (e.g., in left and right directions as illustrated in FIG. 9) until locking strap 262 is intentionally released.

In this embodiment, a releasable securement lock, closing loop 258, is secured to the right portion 254 of rescue strap 210. The closing loop 258 has a length that is slightly longer than closing pocket 257 is wide, which is also secured to right portion 254, as shown. In this embodiment, closing pocket 257 is a length of reinforced material that is stitched to right portion 254 along at least two sides, so as to form a pocket into which a securement member, in this embodiment, closing pin 256, can be inserted.

In this embodiment, closing pin 256 is coupled to an end portion of a shiftable release strap 251 as shown, and configured to be inserted through the closing loop 258 and into closing pocket 257 as shown, in order to prevent closing loop 258 from reversing through ring 260 until such action is purposefully engendered. In this embodiment, such action causes left (252) and right (254) portions of rescue strap 210 to decouple from base 201. Release strap 251 extends through elongate pocket 255, which itself is attached to right portion 254, to a position along right portion 254 that is reachable by a wearer of the TERA 200 to manually decouple rescue strap 210 from base 201.

Referring back to FIG. 8 in particular, in this embodiment, a portion of the outward-facing side of elongate pocket 255 (i.e., that portion visible in FIGS. 8 and 9) includes one-half (e.g., the 'hook' side) of a hook-and-loop fastening component. In this embodiment, a portion of release strap 251 has coupled thereto the opposite half (e.g., the 'loop' side) of the hook-and-loop component, and is configured to be doubled back upon the outer surface of pocket 255 after extending fully through pocket 255 as shown. In this embodiment, an end portion of the release strap 251 includes D-ring 253, thereby providing a graspable element for the wearer (e.g., a rescuer) to grip for activating the release mechanism 250 as described herein. It should be understood that D-ring 353 is one of many possible elements that can be used to provide a graspable element for the wearer.

In the rescue-operable configuration of release assembly 250 shown in FIGS. 8 and 9, the left (252) and right (254) portions of rescue strap 210 are effectively coupled to form a rescue strap or belt for rescue operations. In this configuration, the left (252) and right (254) portions are substantially precluded from releasing from base 201, as oppositely outward-shifting forces between rings 264 and 266, e.g., in the left and right directions as shown in FIGS. 8 and 9, are defeated by the presence of locking strap 262 extending therethrough.

Referring now to FIG. 10, the left (252) and right (254) portions of rescue strap 210 are shown in a decoupled configuration after the release mechanism 250 has been activated. In this example, the left (252) and right (254) portions have been decoupled from the base 201, allowing the wearer (e.g., the rescuer) to free himself of the rescue strap 210 completely. In this example, the release mechanism 250 has been activated by the wearer pulling release strap 251 such that closing pin 256 slidably disengages from closing pocket 257. Such action allows closing loop 258 to shift through ring 260, thereby unlocking locking strap 262 from the configuration shown, e.g., in FIGS. 8 and 9. With one end of locking strap 262 being free, rings 264, 266, and thereby left (252) and right (254) portions can separate completely from base 201.

Referring now to FIG. 11, TERA 200 is illustrated in an operable rescue/extrication configuration, being worn by a rescuer; in this example, a SWAT team member. In this example, TERA 200 is attached to the rescuer's MOLLE vest using PALS webbing as previously described. The rescuer has deployed left (252) and right (254) portions of rescue strap from base 201, extended them about the victim's upper torso and has coupled the end portions together by coupling carabineer 212 to snap shackle 214. While not visible in FIG. 11, the coupling mechanisms of rescue strap 210, e.g., carabineer 212 and snap shackle 214, can be preferably attached medially to the victim, e.g., near the sternum so that the end portions can be uncoupled without encumbrance when desired. The rearward broken-line arrows in FIG. 11 indicate a direction of travel that the rescuer may take when performing extrication of the victim from a hostile or otherwise unsafe environment. By walking backwards, the rescuer can maintain optimal balance, use his weight to aid in pulling the victim (by leaning backwards) and maximize leg muscle usage to avoid back injury. Furthermore, the extrication posture exemplified in FIG. 11 allows the rescuer to have his hands free, in this case, to provide weapons cover for himself and the victim.

FIG. 11 illustrates several features and advantages of a TERA 100/200 system. For example, the TERA 100/200 elevates the rescuee's body so that drag is minimized, which can reduce the effort required of the rescuer. In this example, only the feet of the victim touch the ground, thereby producing minimal drag. In another aspect, the rescuer may stand up straight and/or lean backwards while supporting the rescuee, which results in a proper center of gravity and thereby a more stable stance. In yet another aspect, the rescuer's hands are free, in this example to provide cover for himself and the rescuee, or to provide return fire if the pair are under attack. The rescuer is also free to use his hands for stability, to brace or lift himself, or perform any other act or motion requiring free hands while performing rescue. In yet another aspect, using the TERA 100/200 and the leverage provided by his body weight, the rescuer can perform rapid extrication of victims without the aid of a partner.

Continuing with the example shown in FIG. 11, should the need arise, the rescuer can detach himself from the rescuee by grasping release strap 251, e.g., using D-ring 253, and pulling outwardly, away from base 201. As described above, this action quickly results in left (253) and right (254) end portions decoupling from base 201, which effectively decouples rescuer and rescuee.

As those in the rescue profession will appreciate, an unconscious or exhausted victim can be particularly difficult to move, in part because they cannot control their limbs to aid in extrication. For example, the victim illustrated in FIG. 11 may slip out of the rescue strap if his arms extend above his head, unless the officer cinches himself to the victim tightly. While this may be satisfactory for a rapid extraction, the victim's ability to breathe and consideration of possible chest or abdominal injuries can be a consideration in placing the rescue strap 210 about the victim's torso.

To address this consideration, in this and other embodiments, graspable handle portions of a TERA, e.g., handle portions 103/104 or 203/204 can be configured to be releasably couplable or attachable to one another. Such a configuration provides the ability to 'lock' the victim's arms in an inferior (downward, as illustrated in FIG. 11) orientation by extending the handle portions 103/104 or 203/204 around the front of the victim and reversibly coupling them together after the rescuer has cinched himself to the rescuee as tightly as desired. FIG. 11 illustrates the advantage of this configuration, wherein the victim's arms are substantially precluded from raising above his head, and thereby the victim is substantially precluded from slipping out of the rescue strap. In one approach, graspable handle portion 203 can include a length of 'hook' material, and graspable handle portion 204 can include a length of 'loop' material of a hook-and-loop fastening material component to allow handle portions 203 and 204 to be rapidly and reversibly joined together with a desired degree of tightness about the victim's arms.

Figure 12:
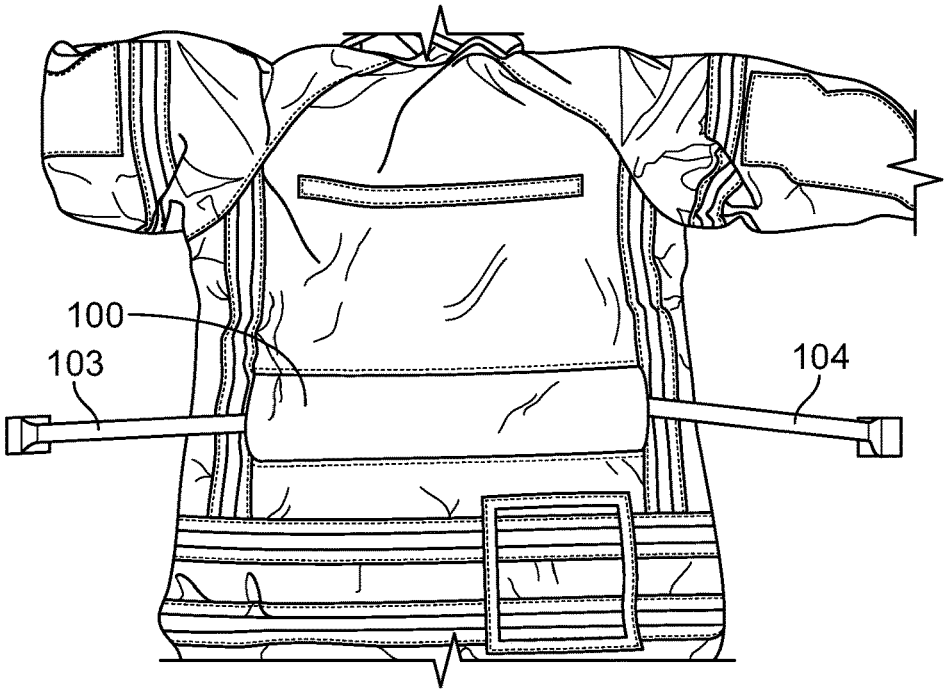
FIG. 12 illustrates a TERA integrated into a firefighting turnout jacket, according to one embodiment.
Figure 13:
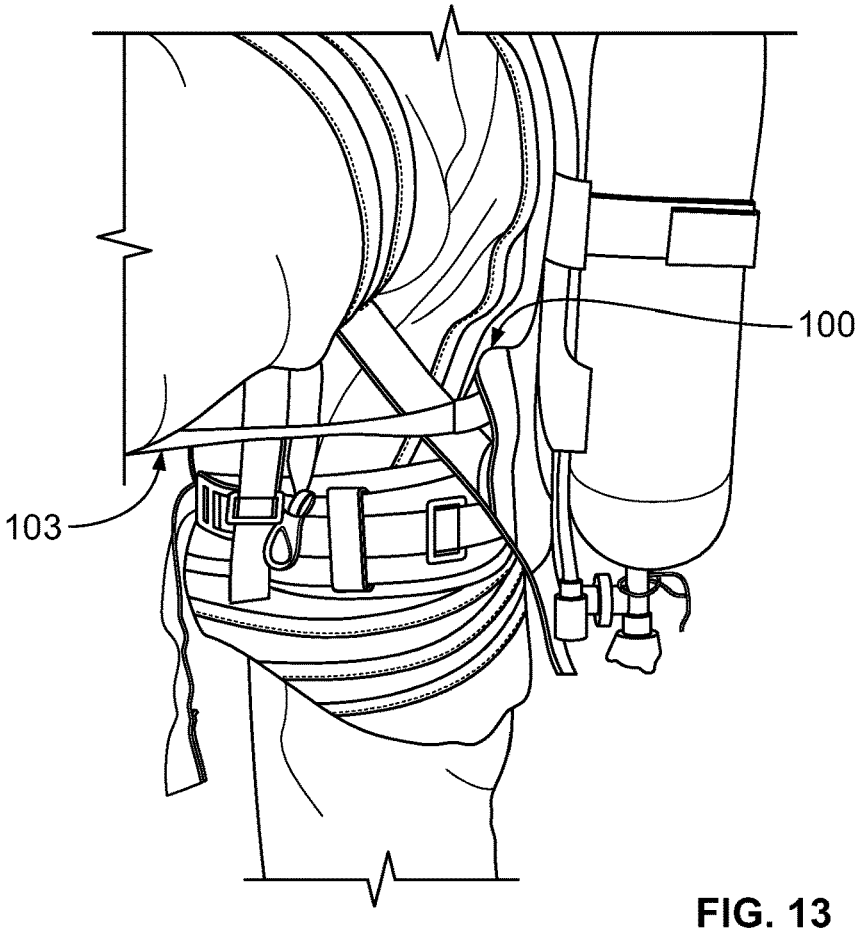
FIG. 13 illustrates a TERA integrated into a firefighting self-contained breathing apparatus (SCBA), according to one embodiment.
Figure 14:
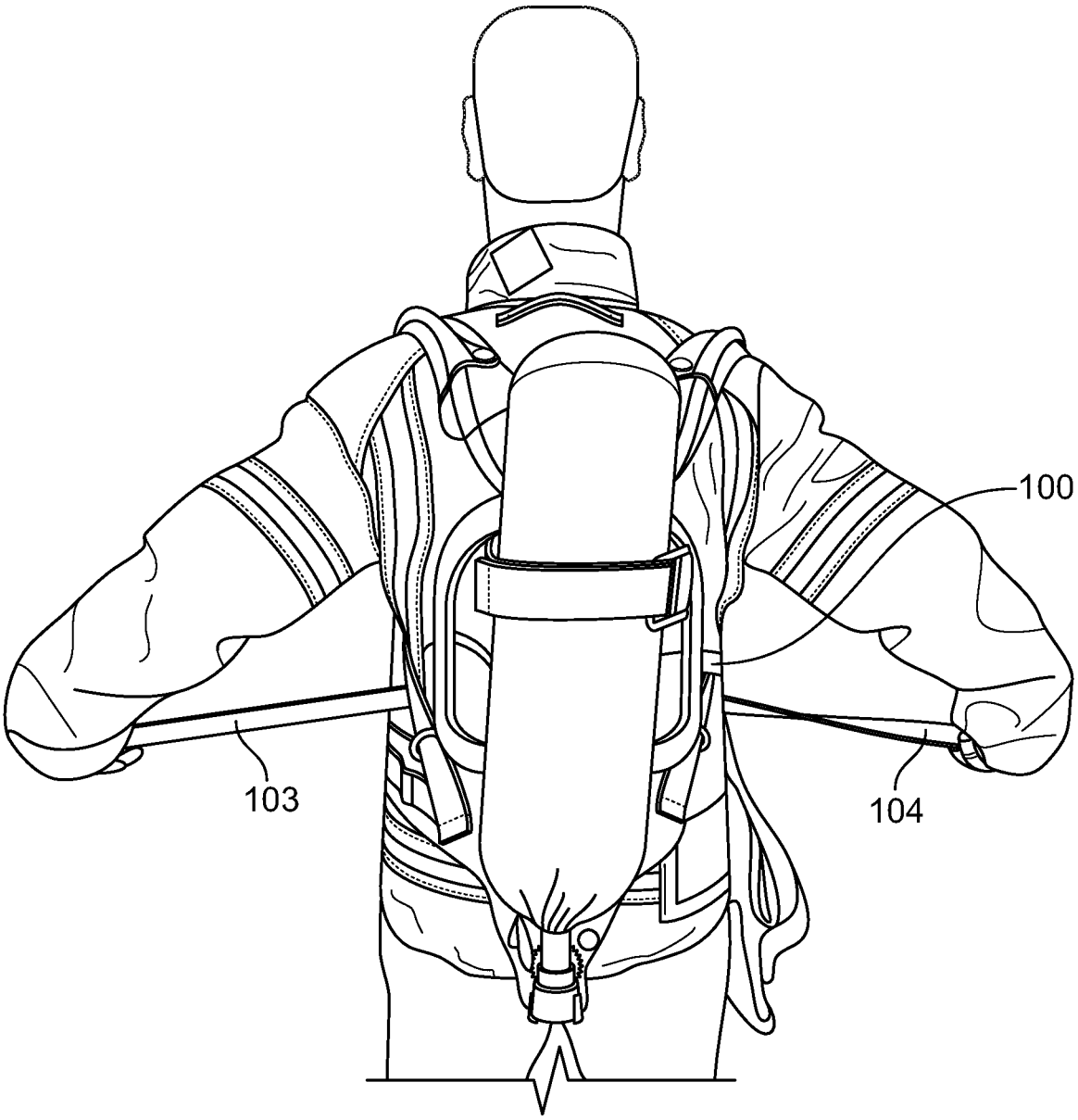
FIG. 14 illustrates deployment of a TERA integrated with a SCBA.

Referring now to FIGS. 12-14, in this and other embodiments, TERA 100 or TERA 200 can be integrated into various types of clothing, gear or other items worn by law enforcement, firefighters, military personnel and others. For example, FIG. 12 illustrates TERA 100 integrated into a firefighter turn-out jacket. In this example, a portion of base 101 of TERA 100 has been stitched directly onto the turnout jacket such that graspable handle members 103, 104 extend therefrom as illustrated. Other attachment approaches can be used as desired; for example, the turnout jacket and base 101 can be configured with a plurality of cooperatively-engaging snaps or buttons so that the TERA 100 can be removed from or added to the turnout jacket with ease. Such a configuration provides TERA 100 as an out-of-the-way piece of rescue equipment that is readily deployable in various situations to effect rescue or extrication of victims or fellow firefighting personnel, if needed.

Referring to FIGS. 13 and 14, in this exemplary embodiment, TERA 100 or TERA 200 can be integrated with, or reversibly attached to a portion of a SCBA. In the exemplary illustration of FIGS. 13 and 14, TERA 100 is shown attached to a bracket portion of the SCBA harness that secures the breathing cylinder in place; however, TERA 100 (or 200) can be attached to any portion of the SCBA harness as desired. TERA webbing components or, optionally, additional straps or other implements can be used to effect the connection between TERA 100 or TERA 200 to a selected piece of gear, clothing or equipment.

FIGS. 13 and 14 illustrate a use of the TERA 100 and 200 where integration into an existing harness system, in this case, the SCBA, can provide the advantage of additional security and leverage when rescuing or extricating a victim from a dangerous environment. For example, a SCBA harness typically includes leg and shoulder straps that the wearer can tighten to a desired comfort level. By integrating the TERA 100 or 200 into such an assembly, the forces associated with dragging a victim to safety can be spread out over a larger area.

A number of illustrative embodiments have been described. Nevertheless, it will be understood that various modifications may be made without departing from the spirit and scope of the various embodiments presented herein. For example, the length of the rescue straps, e.g., rescue straps 110 or 210 can be chosen as desired; relatedly, a TERA can be provided in various pre-configured sizes, e.g., small, medium or large to accommodate the size of the rescuer and the intended rescuees. Similarly, the width of the rescue strap can be chosen as desired. Flexible hook-and-loop fastening components have been described herein for the purpose of retaining the rescue strap 110/210 within base 101/201 and to keep the base 101 closed in a deployable configuration. However, it should be understood that any other type of fastening material, mechanism or component can be used as an alternative to accomplish the same or similar functionality. The rescue straps disclosed herein can be formed of any desired material; heavy-duty nylon strapping is one preferred material. Accordingly, other embodiments are within the scope of the following claims.

What is claimed is:

1. A rescue harness assembly, comprising:

a rescue strap secured to a base member, said base member comprising at least one mounting element for securing said base member to an article of clothing or gear;

first and second connection members disposed on first and second end portions, respectively, of said rescue strap;

wherein said base member is configured to contain said rescue strap in a pre-deployed configuration wherein left and right end portions of said rescue strap extend exteriorly from said base member to form graspable handle members for deploying said rescue strap, for each of said left and right end portions of said rescue strap, at least one keeper component configured to releasably secure a portion of said rescue strap proximal to said graspable handle members to said base member;

wherein said keeper component comprises:

a hook-side or loop-side length of a hook-and-loop fastener closure system secured to said rescue strap proximal to said graspable handle member; and a hook-side or loop-side length of a hook-and-loop fastener closure system secured proximal to a side of said base member;

wherein, for each of said first and said second end portions of said rescue strap:

a first keeper component is configured to releasably secure a first side portion of said rescue strap to a first face portion of said base member; and a second fastening component is configured to releasably secure a second side portion of said rescue strap, diametrically opposite to said first side portion, to a second face portion of said base member, such that when said base member is folded into said pre-deployed configuration, said first side portion of said rescue strap confronts said first face portion of said base member, and said second side portion of said rescue strap confronts said second face portion of said base member.

2. The rescue harness assembly of claim 1, wherein said at least one mounting element of said base member is configured for attachment to MOLLE or ALICE equipment or to an SCBA assembly.

3. The rescue harness assembly of claim 1, wherein said base member comprises a fastener component disposed on at least one perimeter side of said base member for maintaining said base member in a folded configuration that envelops said rescue strap in said pre-deployed configuration.

4. An assembly for the rescue or extrication of a rescuee, comprising:

a base member configured to be wearable by a rescuer;

a rescue strap reversibly coupled to said base member, said rescue strap comprising separate first and second rescue strap portions and first and second graspable handle portions on opposing end portions of said rescue strap; and a coupler independently disposed on each half of said rescue strap capable of providing a connection between said rescuer and said rescuee;

a locking member attached to said base member; and first and second coupling members secured to said first and said second rescue strap portions, respectively;

wherein said locking member and each of said first and second coupling members are cooperatively configured to releasably interlock each of said first and second rescue strap portions to each other and to said base member.

5. The assembly of claim 4, wherein said coupling member is a coupling ring.

6. The assembly of claim 4, further comprising:

a securement assembly for releasably securing said locking member in a configuration that prevents said coupling members and said locking member from unintentional release.

7. The assembly of claim 6, wherein said securement assembly comprises:

a pocket disposed on said base member;

a releasable securement lock disposed on said base member proximal to said pocket; and a securement member;

wherein said releasable securement lock is configured to pass through and fold over an end portion of said locking member or a ring secured to an end portion of said locking member;

wherein said pocket is configured to snugly receive said securement member; and wherein said securement member is configured to pass through said releasable securement lock and be inserted into said pocket to prevent said coupling members and said locking member from being unintentionally released.

8. The assembly of claim 6, further comprising a release member coupled at one end to said securement member and extending along a length of said first or said second rescue strap portion, providing the capability of shifting said securement member from said pocket to release said first and said second rescue strap portions from said base member.

9. The assembly of claim 4, wherein said base member comprises an area of flexible material having a closure system configured to retain said flexible material in a folded configuration that at least partially envelops said rescue strap, exclusive of said first and said second graspable handle portions, in a deployable configuration.

10. The assembly of claim 9, further comprising:

at least one keeper assembly configured to prevent deployment of said rescue strap from said base member, until said graspable handles are pulled outwardly to deploy said rescue strap.

11. The assembly of claim 10, wherein said keeper assembly comprises:

a first portion of a fastener system disposed on said rescue strap proximal to said graspable handle portion and a second portion of said fastener system disposed proximal to a peripheral edge of said base member;

wherein said first and said second portion of said fastener system are releasably fastenable and configured to retain said rescue strap within said base member until said graspable handles are pulled outwardly to deploy said rescue strap.

12. The assembly of claim 11, wherein said fastening system is a hook-and-loop fastening system.

13. A rescue assembly for rapid extrication, comprising:

a flexible base member configured to be worn by a rescuer that is convertable between open and closed configurations;

a rescue strap comprised of first and second strap portions that are reversibly interconnectable by a first interlocking system disposed on said base member, wherein each of said first and second portions of said rescue strap comprise a graspable handle member for deploying said rescue strap from said base member in said closed configuration and a connection member configured to couple to the connection member of the opposite strap portion; and wherein said rescue strap is configured to be extended around both said rescuer and a rescuee; and a release handle disposed on either of said first or said second strap portions configured to release said first and said second strap portions from said base member;

wherein each of said graspable handle members or a portion of each of said rescue strap portions are configured to be reversibly attached to each other.

14. The rescue assembly of claim 13, wherein said rescue strap is configured such that said connection members of said first and said second portions of said rescue strap are capable of being connected about the chest of said rescuee, and said graspable handle members are configured to lock said rescuee's arms in an inferior orientation.

15. The rescue assembly of claim 13, wherein said base member is configured to be attached to MOLLE or ALICE equipment or an SCBA assembly.

* * * * *